US008083227B2

(12) United States Patent
Mizubata et al.

(10) Patent No.: US 8,083,227 B2
(45) Date of Patent: Dec. 27, 2011

(54) SHEET ALIGNMENT APPARATUS AND SHEET POST-PROCESSING APPARATUS

(75) Inventors: Tsuyoshi Mizubata, Hachioji (JP); Hisao Hosoya, Sagamihara (JP); Satoru Shimizu, Hachioji (JP); Tsuyoshi Shiokawa, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 323 days.

(21) Appl. No.: 11/296,120

(22) Filed: Dec. 6, 2005

(65) Prior Publication Data

US 2006/0290045 A1 Dec. 28, 2006

(30) Foreign Application Priority Data

Jun. 28, 2005 (JP) ..... 2005-187949

(51) Int. Cl.
*B65H 31/36* (2006.01)

(52) U.S. Cl. ..... 271/221; 271/207; 270/58.12; 270/58.16

(58) Field of Classification Search ..... 271/240, 271/238, 234, 226, 221, 224, 207; 270/58.12, 270/58.16
See application file for complete search history.

(56) References Cited

U.S. PATENT DOCUMENTS 4,657,239 A * 4/1987 Ikesue et al. ..... 271/227
5,092,509 A * 3/1992 Naito et al. ..... 227/99
5,509,647 A * 4/1996 Iwanaga ..... 271/238
5,657,977 A * 8/1997 Kato et al. ..... 270/52.14
5,762,328 A * 6/1998 Yamada et al. ..... 270/58.08
6,330,999 B2 * 12/2001 Coombs et al. ..... 270/58.18
7,261,290 B2 * 8/2007 Funk et al. ..... 271/171

FOREIGN PATENT DOCUMENTS

JP 60026545 A * 2/1985
JP H5-73653 8/1993
JP 06009064 A * 1/1994
JP H10-297815 11/1998

OTHER PUBLICATIONS

Office Action dated Jul. 6, 2007, from Japanese Patent Office in Japanese application serial No. 2005-287949.
Office Action dated Jul. 6, 2007, from Japanese Patent Office in Japanese application serial No. JP 2005-187949.
English translation of Office Action dated Jul. 6, 2007.
Partial English translation of Utility Model Application Publication H5-73653.

* cited by examiner

*Primary Examiner* — Stefanos Karmis
*Assistant Examiner* — Luis A Gonzalez
(74) *Attorney, Agent, or Firm* — Squire, Sanders & Dempsey (US) LLP

(57) ABSTRACT

An object of the invention is to provide a sheet alignment apparatus that is excellent in alignment properties in the conveyance direction and operates stably without being affected by various conditions, and a sheet post-processing apparatus having therein the sheet alignment apparatus. Alignment members are constructed so that alignment surfaces of the alignment members arranged to be in a form where a distance between the alignment surfaces grows greater toward the downstream side, or the direction of movement of the alignment member is made to be an oblique direction pointing to the stopper.

7 Claims, 4 Drawing Sheets

SHEET ALIGNMENT APPARATUS AND SHEET POST-PROCESSING APPARATUS

This application is based on Japanese Patent Application No., 2005-187949 filed on Jun. 28, 2005, in Japanese Patent Office, the entire content of which is hereby incorporated by reference.

BACKGROUND OF THE INVENTION

The present invention relates to a sheet alignment apparatus for aligning a sheet-shaped sheet and to a sheet post-processing apparatus having therein the sheet alignment apparatus.

In many cases, a high-speed image forming apparatus such as an electrophotographic image forming apparatus is used in combination with a sheet post-processing apparatus that conducts post-processing including stapling, punching, folding and shifting on a sheet on which an image has been formed, and it is common that a sheet post-processing apparatus is equipped with a sheet stacking device that stacks plural sheets to form a bundle of sheets.

Many sheet stacking devices need functions to stack sheets by aligning edges of sheets which are fed in on a one sheet-by one sheet basis or on a several sheets by several sheets basis, in every direction, and-they are equipped with sheet alignment apparatuses each aligning a sheet edge in the vertical direction, namely, in the conveyance direction of a sheet to be fed in.

As described in Patent Document 1, for example, the sheet alignment apparatus has therein an alignment member that reciprocates in the direction crossing the conveyance direction in the case of feeding a sheet into the sheet stacking-device, to align the side edge of the sheet, and a stopper that is hit by a leading edge of the sheet when it is fed in, whereby, sheets which slide down along the inclined support member are aligned in every direction.

(Patent Document 1) Non-examined Publication Application No. 10-297815

SUMMARY OF THE INVENTION (Item 1)

A sheet alignment apparatus for aligning a sheet, comprising: a pair of alignment members which have alignment surfaces to press an edge of the sheet and align the sheet; a driving source to drive the alignment members to reciprocate in a direction crossing sheet conveyance direction Y when feeding the sheet into sheet alignment portion provided the alignment members, and a stopper to catch a leading edge of the sheet in the sheet conveyance direction Y, wherein the alignment surfaces are tilted from the sheet conveyance direction Y so that the width between the alignment surfaces is wider at the downstream side in the sheet conveyance direction Y than at the upstream side.

(Item 2)

A sheet alignment apparatus for aligning a sheet, comprising: a pair of alignment members to press an edge of the sheet and to align the sheet; a driving source to drive the alignment members to reciprocate, and a stopper to catch a leading edge of the sheet in the sheet conveyance direction Y when feeding the sheet into sheet alignment portion provided the alignment members, wherein the driving source drives the alignment members to reciprocate in oblique direction W which is a compound direction of sheet conveyance direction Y and direction X being perpendicular to sheet conveyance direction Y.

(Item 3)

A sheet post-processing apparatus having therein a sheet alignment apparatus described in Items 1 or 3, and a support member which supports a sheet.

BRIEF DESCRIPTION OF THE DRAWINGS

FIG. 5(*b*) is a diagram for illustrating aligning actions of sheets.

FIG. 5(*c*) is a diagram for-illustrating aligning actions of sheets.

DETAILED DESCRIPTION OF THE PREFERRED EMBODIMENT

The invention will be explained as follows, referring to the embodiment illustrated as follows, to which, however, the invention is not limited.

<Image Forming Apparatus>

Figure 1:
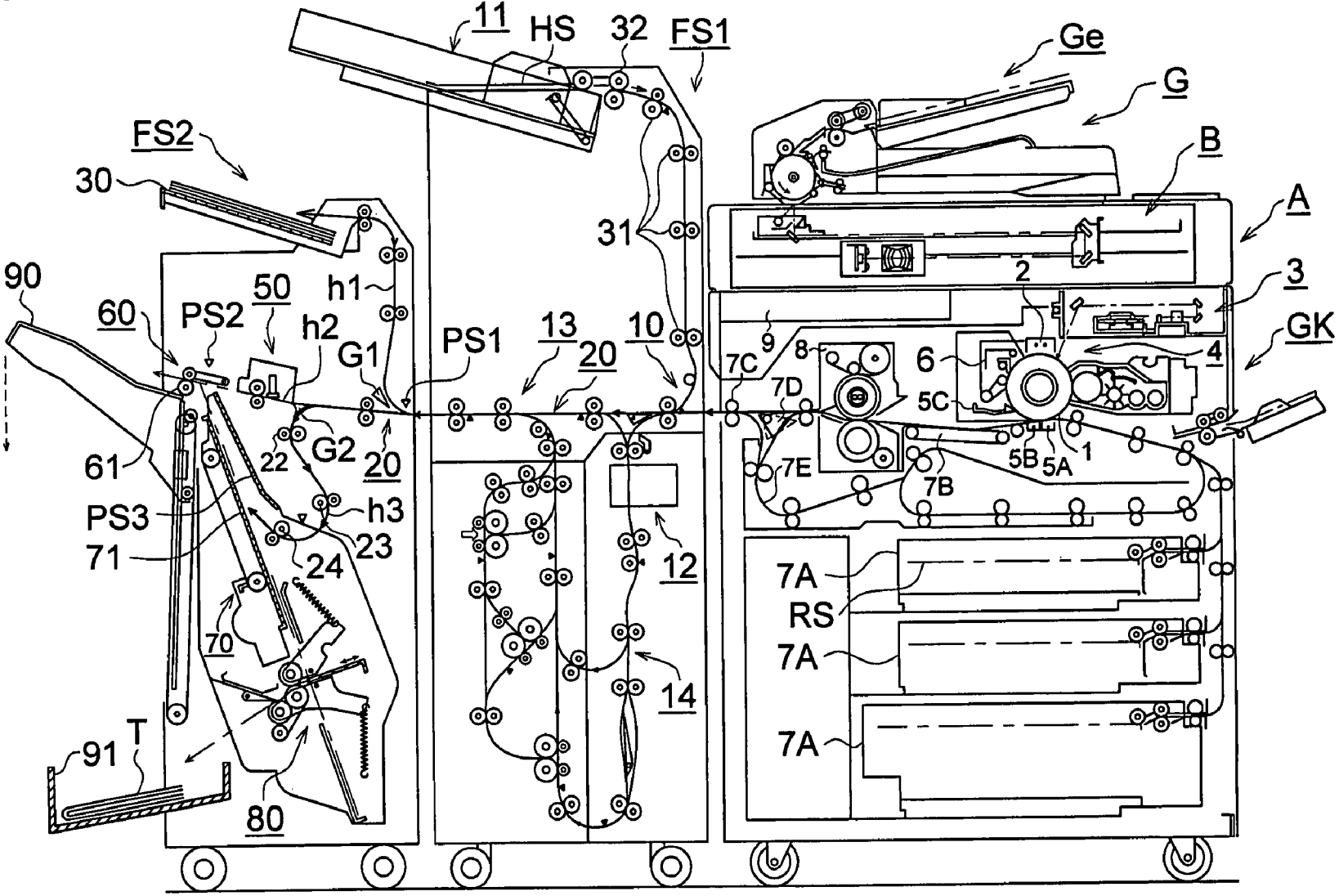
FIG. 1 is a total structural diagram of an image forming apparatus having therein a sheet alignment apparatus and a sheet post-processing apparatus both relating to the embodiment-of the invention.

FIG. 1 is a total structural diagram of an image forming apparatus having therein a sheet post-processing apparatus both relating to the embodiment of the invention.

Image forming apparatus main body A has image forming section GK wherein charging device 2, image-wise exposure device 3, developing device 4, transfer device 5A, neutralizing device 5B, separation claw 5C and cleaner 6 are arranged around rotating photoconductor 1, and a surface of the photoconductor 1 is charged evenly with electricity by the charging device 2, then, a latent-image is formed through exposure based on image data obtained by reading from document Ge to be copied by laser beam of the image-wise exposure device 3, or on image data received from the outside through a network, and a toner image is formed on the surface of the photoconductor 1 through reversal development.

On the other hand, recording sheet RS fed from sheet-feeding tray 7A representing a sheet storing section is conveyed to the transfer position where the toner image is transferred onto the recording sheet RS by transfer device 5A. After that, electric charges on the reverse side of the recording sheet. RS are removed by neutralizing device 5B, the recording sheet is separated from the photoconductor 1 by separation claw 5C, to be conveyed to intermediate conveyance section 7B, and is fixed successively by fixing section 8 to be ejected by sheet-ejecting roller 7C.

When conducting image forming on one side of the recording sheet RS, conveyance path switching plate 7D representing one of sheet conveyance means is switched to the position shown with dotted lines.

Further, developer, namely, toner remaining on a surface of the photoconductor 1 on which an image has been formed is removed by cleaner 6 at the position on the downstream side of the separation claw 5C, so that the surface of the photoconductor 1 may be ready for the succeeding image forming.

On the other hand, when-conducting image forming on both sides of the recording sheet RS, by switching conveyance path switching plate 7D to the position shown with solid lines, recording sheet RS which has been heated and fixed by fixing section 8 is conveyed downward, and it moves in a switchback manner at reversal conveyance section 7E representing one of sheet conveyance means to be reversed inside out, and is moved to the transfer position where a new toner image is transferred onto the reverse side thereof.

As is further described later, when conducting punching processing, folding processing and binding processing, by switching conveyance path switching plate 7D to the position shown with solid lines, recording-sheet RS which has been heated and fixed by fixing section 8 is conveyed downward, and it moves in a switchback manner at reversal conveyance section 7E to be reversed inside out, and it moves upward with its rear edge taking the lead, to be ejected by sheet-ejecting roller 7C.

The recording sheet RS ejected from the sheet-ejecting roller 7C is fed into first sheet post-processing apparatus FS1.

Incidentally, on the front side at upper portion of image forming apparatus main body A, there is arranged operation-display section 9 capable of selecting from various types such as an image forming mode and a sheet post-processing mode to establish, and on the upper portion of the image forming apparatus main body A, there is installed image reading apparatus B representing an image reading section equipped with automatic document conveyance device G of a reading type of a document moving type. Image data obtained through reading by image reading-apparatus B and image data received from the outside through facsimile communication or through network communication are stored in a storage device (not shown).

The first sheet post-processing apparatus FS1 is a sheet post-processing apparatus that conducts punching processing and folding processing, and second sheet post-processing apparatus FS2 is a sheet post-processing apparatus that conducts shifting processing and binding processing.

The first sheet post-processing apparatus FS1 has punching processing section 12 and folding processing section 14, and punching processing or folding processing is conducted for recording sheet RS ejected to entrance portion 10 from image forming apparatus main body A and a cover supplied from cover supply tray 11.

As illustrated, folding processing section 14 has some branch conveyance paths, and various folding processing such as 2-folding and 3-folding are carried out by using properly the branch conveyance paths.

On the upper stage of the second sheet post-processing apparatus FS2, there is arranged fixed sheet ejection tray 30 that is used as a sub-tray, and shifting section 50 and sheet-ejecting section 60 are arranged along conveyance path h2 which is substantially horizontal, and binding device 70 and center-folding device 80 are arranged on the lower stage.

On the left side portion in the second sheet post-processing apparatus FS2, there is arranged main tray 90 on which a sheet subjected to shifting processing and a sheet bundle subjected to edge binding (stapling) processing are stacked, and lower tray 91 to which a sheet subjected to center-folding processing is ejected is arranged on the lower portion on the left.

Figure 2:
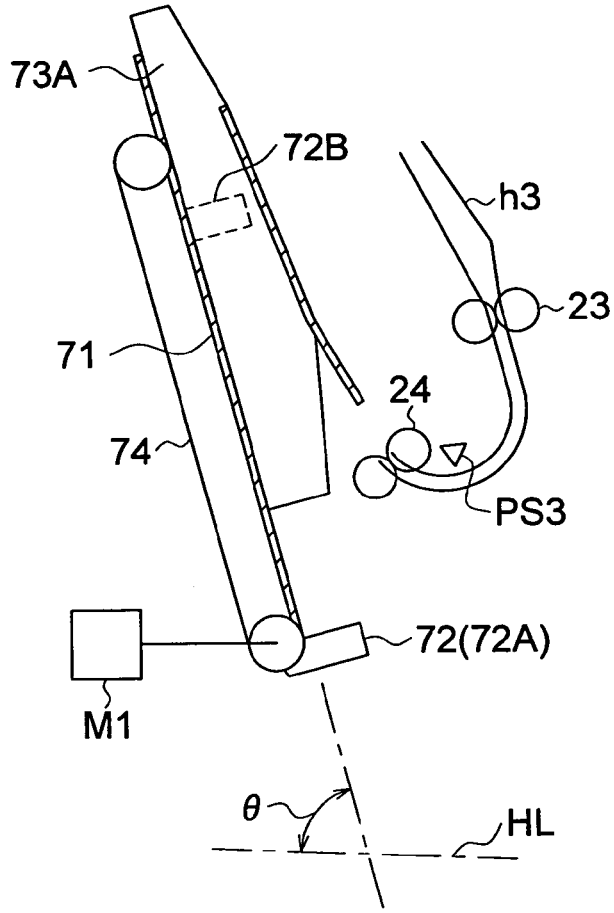
FIG. 2 is a diagram showing primary portions of a sheet post-processing apparatus relating to the embodiment of the invention.
Figure 3:
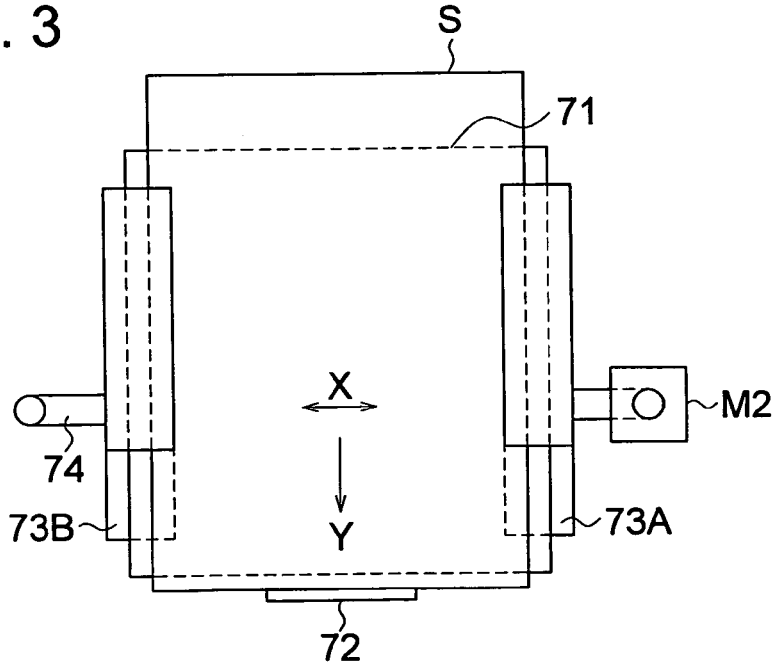
FIG. 3 is a plan view of a sheet alignment apparatus relating to the embodiment of the invention.

Next, the structure of the second sheet post-processing apparatus FS2 will be explained based on FIGS. 1-3. FIG. 2 shows a portion of an intermediate stacker that is a primary portion of the second sheet post-processing apparatus FS2, and FIG. 3 is a plan view of a sheet alignment apparatus. Incidentally, in the following explanation, recording sheet RS and cover HS are called sheet S generically.

Sheet S ejected from the first sheet post-processing apparatus FS1 is fed into entrance portion 20 of the second sheet post-processing apparatus FS2.

A sheet branching section composed of switching gates G1 and G2 is provided on the downstream side of the entrance portion 20. The switching gates G1 and G2 are driven by an unillustrated solenoid to select any one of three conveyance paths including first conveyance path h1 for the upper stage sheet ejection, second conveyance path h2 for the medium stage and third conveyance path h3 for the lower stage.

In the case of image forming for a small number of sheets, switching gate G1 intercepts the second conveyance path h2 and third conveyance path h3, and keeps only the first conveyance path h1 open. Sheet S proceeds through the first conveyance path h1 to be interposed by conveyance rollers located at the downstream side to ascend, and is ejected by ejection rollers to be stacked on sub-tray 30 in order.

Incidentally, the maximum 200 sheets S can be stacked on the sub-tray 30.

Further, in the case of the mode to form large quantities of images without performing the staple processing, the switching gate G1 intercepts the first conveyance path h1, while, the switching gate G2 intercepts the third conveyance path h3 and keeps the second conveyance path h2 open to make it possible for sheet S to pass through, whereby, the sheet S is guided and ejected to main tray 90. In the mode to eject sheet S to main tray 90 through the second conveyance path h2, it is possible to conduct shift processing in which the sheet S is shifted by shifting section 50. The shifting section 50 conducts shift processing wherein a position in the lateral direction for ejecting sheet S is changed every prescribed number of sheets. The main tray 90 is a structure in which the main tray goes down successively when a large number of sheets S are stacked thereon, and it can accept the maximum 3000 sheets in the case of A4 or B5 size.

In the vicinity of sheet ejection roller 61 that constitutes the sheet-ejecting section 60, there is arranged sheet sensor PS2 that detects a passage of the sheet S to be ejected to the main tray 90.

The sheet S ejected from the first sheet post-processing apparatus FS1 is conveyed through the third conveyance path h3 by conveyance rollers 22 and 23, and is caused by stacker ejection rollers 24 to rise upward to the left on intermediate stacker 71, then, the trailing edge of the sheet S passes through the stacker ejection rollers 24 to leave them, and is dropped along the intermediate stacker 71 by gravity.

The intermediate stacker 71 is a support member on which the sheet S introduced is placed, and it is inclined from horizontal line HL by angle θ as illustrated, and it is preferable that angle θ satisfies angle $\theta \geqq 60°$ for improving alignment properties to align leading edges of sheets S, and for making an apparatus small.

At the moment when the lower edge of sheet S (leading edge in the conveyance direction in feeding) arrives at stopper 72, a pair of alignment-members 73A and 73B move in a lateral direction, namely, in the X direction in FIG. 3 to reciprocate, and align-sheets S in a-lateral direction.

Actions explained above are given to sheets S supplied to intermediate stacker 71, thus, aligned sheets S in prescribed number are stacked on the intermediate stacker 71.

At the moment when the sheet S in prescribed number are stacked, binding device 70 operates to conduct binding processing for a bundle of sheets S.

At the moment when the binding processing is completed, stopper 72 is lifted upward obliquely to the left in FIGS. 1 and 2 by belt 74 that is driven by motor M1, to push up a bundle of sheets S to eject it to main tray 90.

The bundle of sheets S stacked on the intermediate stacker 71 is conveyed downward obliquely again, and is center-folded by center-folding device 80 to be ejected to lower tray 91.

<Alignment of Sheets>

Alignment of sheets will be explained as follows, referring to FIGS. 1-5. FIG. 2 is a diagram showing primary portions of a sheet post-processing apparatus relating to the embodiment of the invention, FIG. 3 is a diagram showing primary portions of a sheet post-processing apparatus relating to the embodiment of the invention FIG. 3 is a plan view of a sheet alignment apparatus, FIG. 4 is a cross-sectional view of an alignment member, and FIG. 5 is a diagram for-illustrating aligning actions for-sheets.

Alignment members 73A and 73B are fixed on belt 74 that is driven by motor M2 representing a driving source, and a regular rotation and a reverse rotation of the motor M2 cause the alignment members to move in opposite directions each other on a reciprocating basis to align sheets S.

Figure 4:
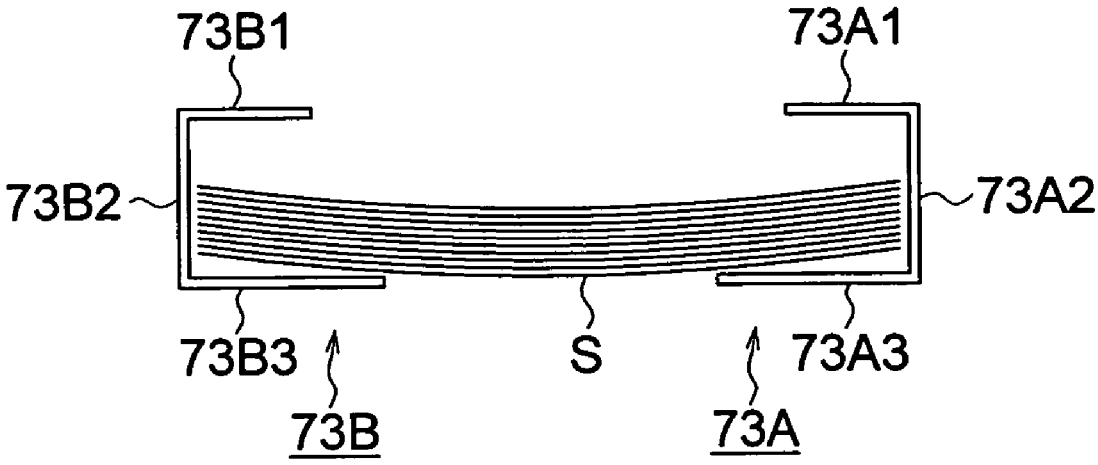
FIG. 4 is a cross-sectional view of an alignment member.

As shown in FIG. 4, alignment member 73A is in a form of U squarely-tilted to the left, and it is composed of upper plate portion 73A1, side plate portion 73A2 and lower plate portion 73A3, while, alignment member 73B is in a form of U squarely-tilted to the right, and it is composed of upper plate portion 73B1, side plate portion 73B2 and lower plate portion 73B3. A left side of the side plate portion 73A2 and a right side of the side plate portion 73B2 are alignment surfaces to align side edges of sheets S, and the side plate portion 73A2 and the side plate portion 73B2 come in contact with side edges of sheets S to align the sheets.

Figure 5:
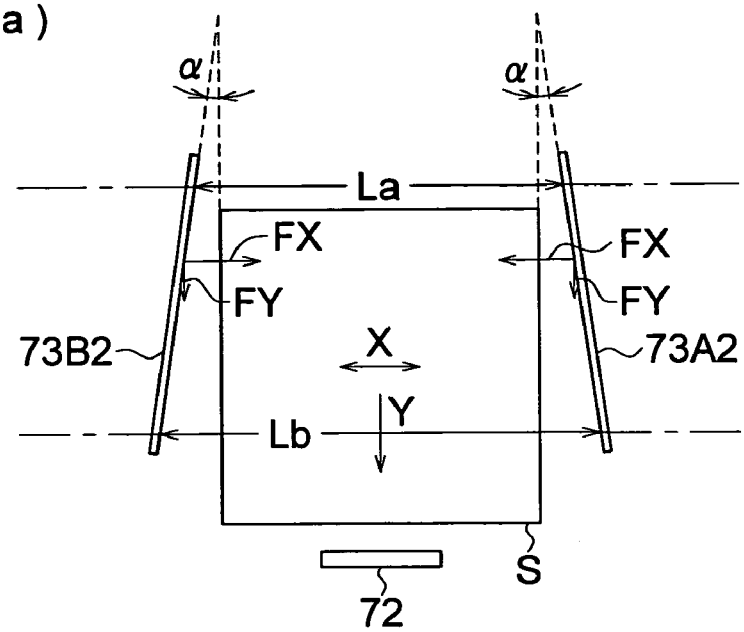
FIG. 5(*a*) is a diagram for illustrating aligning actions of sheets.
Figure 5:
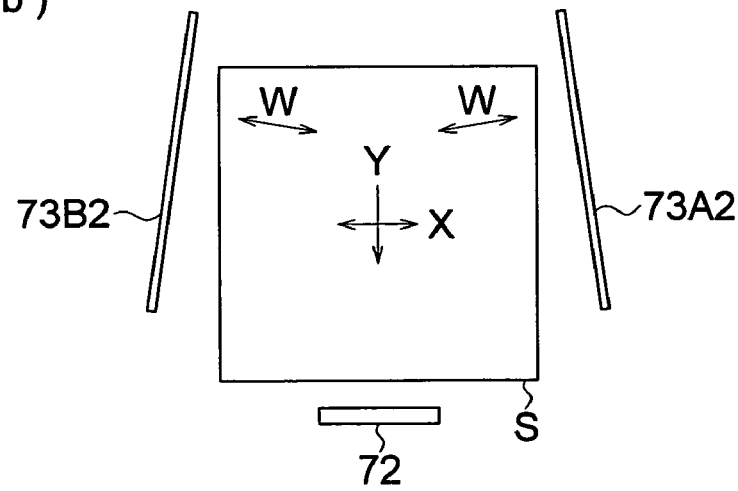
Figure 5:
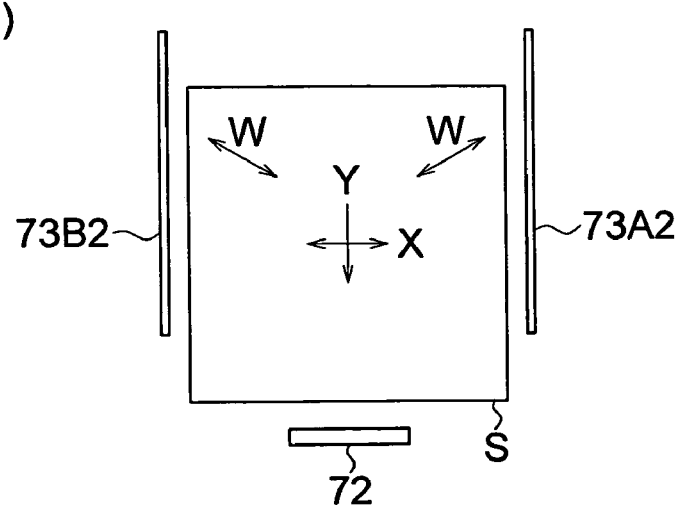

FIG. 5 shows the side plate portions 73A2 and 73B2, and in the example in FIG. 5(*a*), the side plate portions 73A2 and 73B2 each having an alignment surface that aligns sheet S are arranged to be in a form that becomes broader toward the stopper 72. Namely, the alignment member 73A and the alignment-member 73B are arranged so that distance Lb between side plate portion 73A2 and side plate portion 73B2 on the downstream side in the sheet conveyance direction Y in the case of feeding in a sheet may be greater than distance La between side plate portion 73A2 and side plate portion 73B2 on the upstream side. The stopper 72 catches the leading edge of the sheet in the sheet conveyance direction in the case of feeding sheet S into the sheet alignment apparatus, and aligns the leading edge of the sheet.

If the alignment members 73A and 73B move in the lateral direction X, namely, in the direction perpendicular to the sheet conveyance direction Y in the case of feeding in sheet S into a sheet stacking device on a reciprocating-basis, force FX in the lateral direction X and force FY in the sheet conveyance direction Y in the case of feeding in a sheet are applied on sheet S. As a result, sheet S is aligned in both the X direction and the Y direction, thus, the sheets are stacked under the condition where leading edges (leading-edges in the sheet conveyance direction in the case of feeding in a sheet) are aligned on the stopper 72.

An inclination angle $\alpha$ of each of the side plate portions 73A2 and 73B2 on the sheet conveyance-direction Y in the case of feeding in a sheet is preferably in a range of 0.05°-0.3°.

By forming the alignment surfaces of the side plate portions 73A2 and 73B2 in the way mentioned above, excellent alignment can be attained even in the case of changes in various conditions such as a case where sheet S to be stacked on the intermediate stacker 71 is curled, a case where temperature and humidity are changed, a case where properties of sheets are different and a case where sheet properties are changed.

When $\alpha$ is smaller than 0.05°, sheet S is sometimes shifted up in the course of alignment by the alignment members 73A and 73B. When $\alpha$ is larger than 0.3°, a play in the lateral direction X grows greater, and a lateral slide is sometimes caused, and in addition, strokes of the alignment members 73A and 73B grow greater to secure a width for conveyance, which results in a large apparatus.

In addition to the example wherein the alignment members 73A and 73B are caused to reciprocate in the X direction as shown in FIG. 5(*a*), it is also possible to move sheet S in the oblique direction W representing a compound of the X direction and the Y direction, when pressing an edge of sheet Si as shown in FIG. 5(*b*). Owing to this, aligning actions in the Y direction are further improved.

As is apparent from FIGS. 1 and 2, when sheet S is fed to the intermediate stacker 71, sheet S advances in the direction opposite to Y direction, then, when the sheet S leaves the stacker ejection roller 24, the sheet S moves in a switchback manner to fall in the Y direction. The side plate portions 72A2 and 73B2 arranged to be in a form that becomes broader toward the stopper 72 function also as a guide in the case of supplying sheet S from the stacker ejection roller 24, and thereby, sheet S can be fed in smoothly.

As shown in FIG. 5(*c*), it is also possible to construct so that side plate portions 73A2 and 73B2 of alignment members 73A and 73B are formed to be in parallel with the sheet conveyance direction Y in the case of feeding in a sheet, and thereby, the alignment members 73A and 73B are caused to move in oblique direction W in a reciprocating manner. In this construction again, sheets S can be aligned excellently both in the lateral direction X and the sheet conveyance direction Y in the case of feeding in a sheet. Driving of alignment members 73A and 73B shown in FIGS. 5(*b*) and 5(*c*) can be conducted by the use of a known transmission mechanism wherein a movement of belt 74 driven by motor M2 is changed into a movement in the oblique direction by a cam.

What is claimed is:

1. A sheet alignment apparatus for aligning a sheet, comprising:

a stopper configured to catch a leading edge of the sheet being conveyed in a sheet conveyance direction Y;

a pair of alignment members which are configured to be movable between a first position and a second position and have alignment surfaces to press an edge of the sheet, whose leading edge is caught by the stopper, and to align the sheet, each of which alignment surfaces is tilted at a first angle to the sheet conveyance direction Y such that a width between the alignment surfaces is wider at a downstream side in the sheet conveyance direction Y than at an upstream side, wherein in the first position the alignment surfaces are separated from the edge of the sheet in a sheet alignment portion provided between the pair of alignment members, and in the second position the alignment surfaces are in contact with and press the edge of the sheet in the sheet alignment portion; and a driving unit configured to drive the alignment members to reciprocate in a direction crossing the sheet conveyance direction Y from the first position to the second position while keeping the first angle of the alignment surfaces when feeding the sheet into the sheet alignment portion.

2. The sheet alignment apparatus of claim 1, wherein the driving unit is configured to drive the alignment members to reciprocate in oblique direction W which is a compound direction of sheet conveyance direction Y and direction X being perpendicular to sheet conveyance direction Y.

3. The sheet alignment apparatus of claim 1, wherein the driving unit is configured to drive the alignment members to reciprocate in the lateral direction X perpendicular to the sheet conveyance direction Y.

4. A sheet post-processing apparatus for post processing a sheet, comprising:

a support member which supports the sheet;

a pair of alignment members which are configured to be movable between a first position and a second position and have alignment surfaces to press an edge of the sheet and align the sheet on the support member, each of which alignment surfaces is tilted at a first angle to a sheet conveyance direction Y such that a width between the alignment surfaces is wider at a downstream side in the sheet conveyance direction Y than at an upstream side, wherein in the first position the alignment surfaces are separated from the edge of the sheet on the support member, and in the second position the alignment surfaces are in contact with and press the edge of the sheet on the support member;

a driving unit configured to drive the alignment members to reciprocate in a direction crossing the sheet conveyance direction Y from the first position to the second position while keeping the first angle of the alignment surfaces when feeding the sheet onto the support member, and a stopper to catch, on the support member, a leading edge of the sheet in the sheet conveyance direction Y.

5. The sheet post-processing apparatus of claim 4, wherein the driving unit is configured to drive the alignment members to reciprocate in oblique direction W which is a compound direction of sheet conveyance direction Y and direction X being perpendicular to sheet conveyance direction Y.

6. The sheet post-processing apparatus of claim 4, comprising a binding device to bind a bundle of sheets on the support member.

7. The sheet post-processing apparatus of claim 4, wherein the driving unit is configured to drive the alignment members to reciprocate in the lateral direction X perpendicular to the sheet conveyance direction Y.

* * * * *